US005964347A

United States Patent [19]

Urness

[11] Patent Number: 5,964,347

[45] Date of Patent: Oct. 12, 1999

[54] PACKAGE FOR A BED SECTION AND A METHOD PACKAGING THE BED SECTION

[75] Inventor: Randall J. Urness, Plover, Wis.

[73] Assignee: Sunrise Medical CCG Inc., Stevens Point, Wis.

[21] Appl. No.: 09/064,483

[22] Filed: Apr. 22, 1998

[51] Int. Cl.[6] ..... B65D 85/00

[52] U.S. Cl. ..... 206/326; 206/576; 206/320

[58] Field of Search ..... 206/315.1, 320, 206/326, 576

[56] References Cited

U.S. PATENT DOCUMENTS 5,216,768 6/1993 Bodine et al. ..... 5/453

*Primary Examiner*—David T. Fidei
*Attorney, Agent, or Firm*—MacMillan, Sobanski and Todd, LLC

[57] ABSTRACT

A package for bed sections and a method of packaging the bed sections includes the head and foot ends which are structured and dimensioned to fit together within a single package so as to form a single parcel and a head section and a foot section, each structured and dimensioned to fit within separate packages so as to form separate parcels. The head and foot ends as well as the head and foot sections each have a length and a girth the sum of which is in the order of 127 inches. A package is provided for containing the head and foot ends, the head section, and the foot section. The package comprises a paperboard box having a length and a girth sum of which does not exceed 130 inches. Neither the head nor foot ends, nor the head section, nor the foot section, and its paperboard box, have a combined weight exceeding 150 pounds. A formula is provided for determining a range of dimensions for the head and foot ends, and the head section, and the foot section. The sum of the length and girth of the paperboard box are known. The paperboard box is fabricated from a paperboard material having a known thickness. The thickness of the paperboard material is factored into the formula used to determine the range of dimensions for the head and foot ends and the head section and the foot section. This permits the head and foot ends and the head section and the foot section to be structured and dimensioned to fit within a paperboard box of limited dimensions.

25 Claims, 10 Drawing Sheets

PACKAGE FOR A BED SECTION AND A METHOD PACKAGING THE BED SECTION

BACKGROUND OF THE INVENTION

This invention relates in general to package and article carriers and more particularly, to a package for a bed section and a method of packaging a bed section.

Manufacturers often use common couriers to distribute their products. The common couriers generally publish guidelines to which the manufacturers must adhere when using the common courier. For example, United Parcel Service of America, Incorporated (UPS) of Atlanta, Ga., provides a formula for determining the maximum size parcel that UPS will transport or deliver. According to this formula, the sum of the length and girth of a parcel cannot exceed 130 inches. Federal Express Corporation of Memphis, Tenn., publishes a similar formula the sum of which cannot exceed 165 inches. These couriers service a large share of the market. The rates of these couriers are very competitive among other couriers, and their area of delivery is very broad. But, if the dimensions of the manufacture's parcel exceed the maximum specified by the formula, the manufacturer is excluded from benefiting from these couriers' competitive rates and area of distribution. The manufacturer may have to resort to using another courier whose rate may be less competitive and whose delivery area may be more limited. Moreover, alternative couriers may be less expedient in delivering parcels. Hence, if possible, it is to the manufacturer's benefit to construct his product in a manner such that the product does not exceed the maximum size permitted for delivery by a desired courier. This becomes a challenge for manufacturers of large articles, such as furniture.

Some furniture manufacturers employ drivers and possess a fleet of trucks for making scheduled deliveries to distributors and consumers. Labor and acquisition of trucks can be too costly for some manufacturing operations. For these manufacturers, product delivery can be contracted out to independent couriers. Various independent couriers likewise have guidelines, such as those imposed by UPS and Federal Express. As the manufacturer's parcel exceeds a greater number of courier guidelines, the manufacturer finds itself seeking a courier from a shrinking market, a market where the manufacturer will bare a greater cost for delivering its goods. For at least this reason, it would behoove the manufacturer to consider the delivery of its product in the course of manufacturing the product.

One factor to consider in producing a product is quite obviously size. It is impractical to produce some products in their entirety prior to delivery because some products are merely too large. Manufacturers recognize this and manufacture and ship goods in subcomponents. The subcomponents are assembled when they reach their destination. This can be a wise alternative for manufacturers who ship goods in their entirety. If it is possible for a manufacturer to ship its goods in subcomponents that may easily be assembled upon delivery, the manufacturer may avail itself to a greater selection of couriers. Hence, the manufacturer may be able to ship its goods directly to its distributors and consumers more expediently and at a lower cost. Some manufacturers may be able to structure products so as not to limit the use of any courier.

Manufacturers of articulating beds, for example, would benefit by structuring and dimensioning the beds in such a manner that the beds could be readily delivered by any courier. This could be accomplished by constructing a bed that could be assembled at its destination point. Articulating beds generally comprise a headboard or head end and a footboard or foot end, and a frame for supporting a sleep surface. The head and foot ends could be structured and dimensioned to be shipped as a single parcel. Moreover, the frame and the sleep surface could likewise be structured and dimensioned to be shipped in sections which could be assembled upon delivery. For example, the frame and sleep surface could be shipped together in two sections, principally a head section and a foot section, which could easily be assembled upon reaching a destination and still not exceed limitations on parcel dimensions imposed by couriers.

SUMMARY OF THE INVENTION

This invention relates to package and article carriers. More particularly, this invention relates to packaging for bed sections and a method of packaging bed sections. The packaging for containing the bed sections comprises a box having a length and a girth. The sum of the length and girth of the box does not exceed 130 inches. The bed section is dimensioned and configured to fit within the internal dimensions of the box. The bed section and the box having a combined weight not exceeding 150 pounds.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
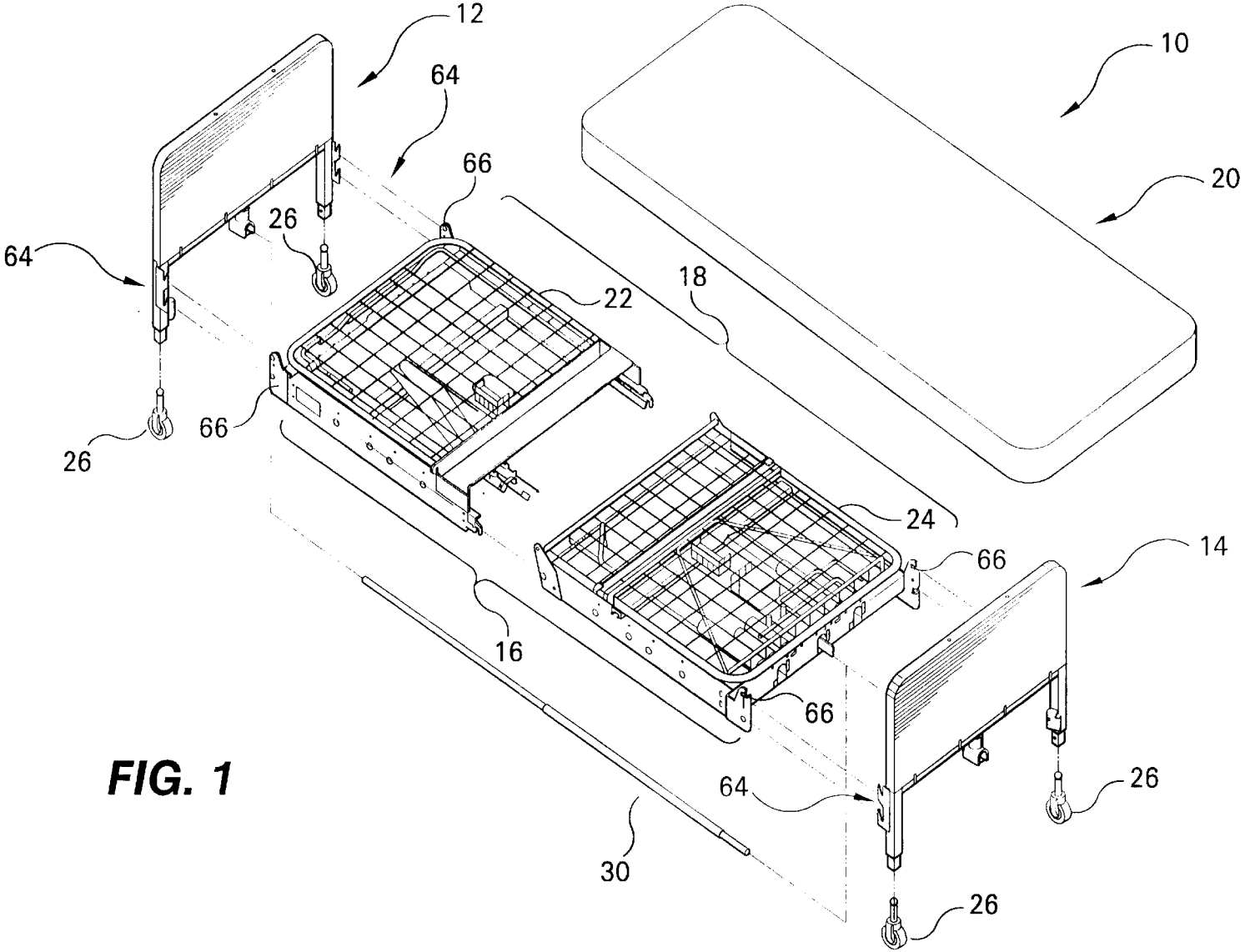
FIG. 1 is an exploded perspective view of an articulating bed.

Referring now to the drawings, there is illustrated in FIG. 1 an articulating bed 10 in a disassembled posture. The bed 10 comprises a head end 12, a foot end 14, and a bed frame 16. The frame 16 supports a sleep surface 18 for supporting a mattress 20. The sleep surface 18 comprises a head section 22 and a foot section 24. The head end and foot ends 12, 14 can be supported by casters 26 to permit the bed 10 to be easily moved.

Figure 2:
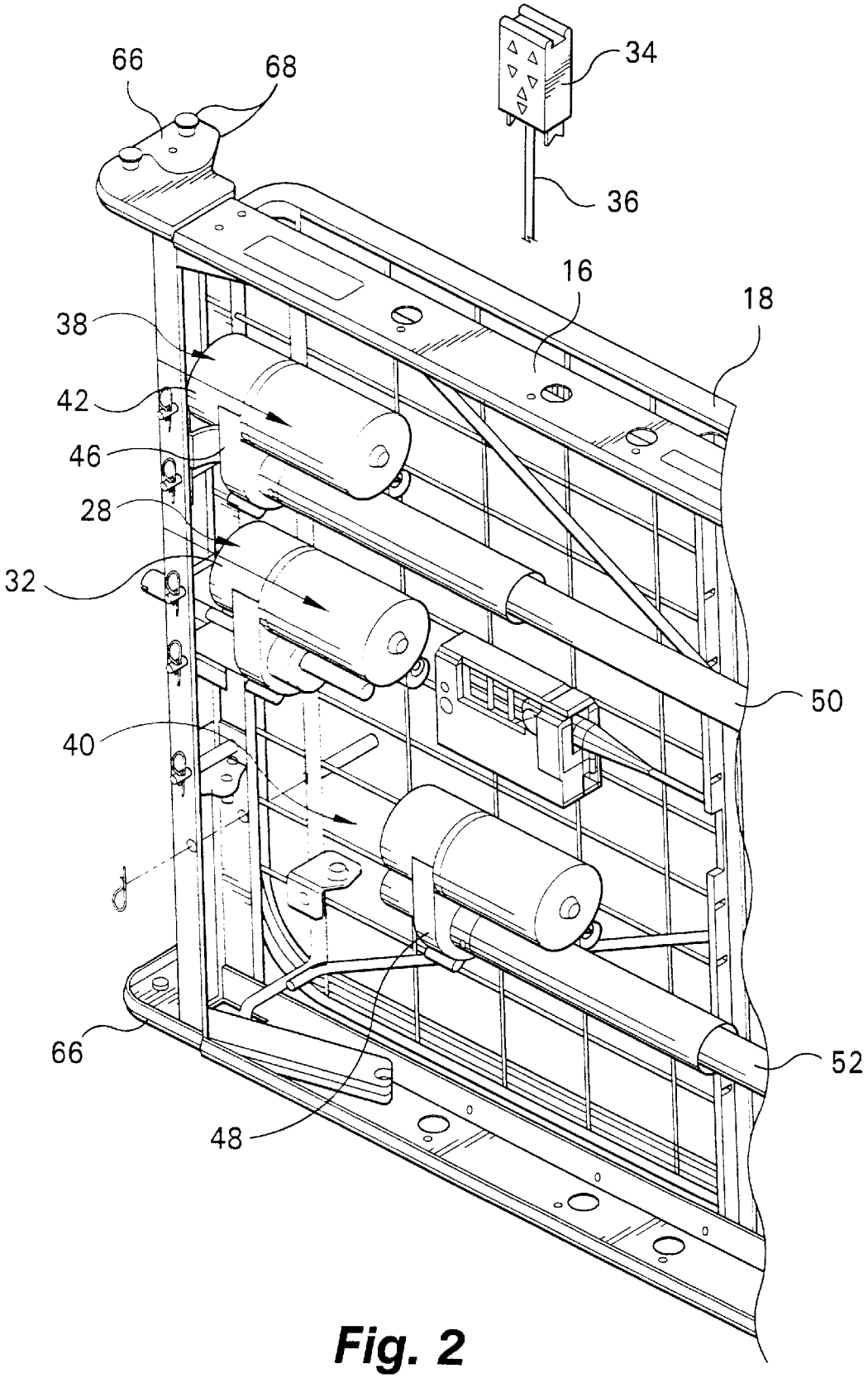
FIG. 2 is a partial bottom perspective view of a foot section of the articulating bed shown in FIG. 1.

The articulating bed may further include a conventional high/low assembly 28, as shown in part FIG. 2. The high/low assembly 28 includes a driveshaft 30 (clearly shown in FIG. 1) for effecting movement of the head and foot sections 22, 24. The driveshaft 30 can be rotatably displaced manually by a handcrank (not shown) or through a prime mover, such as the motor 32 shown. The high/low assembly 28 is supported within the bed frame 16 and beneath the sleep surface 18. The driveshaft 30 is connected to a conventional cable configuration (not shown). The cable configuration cooperates with the head and foot ends 12, 14 of the bed 10 to raise and lower the head and foot ends 12, 14. Upon rotatably displacing the driveshaft 30, movement of the cable configuration is effected to simultaneously raise or lower the head and foot end 12 of the bed 10. A pendant 34 and power cord 36 can be provided for operating electrically controlled high/low assemblies.

In addition to the high low assembly 28, screw assemblies 38, 40 can be provided for elevating the head and foot sections 22, 24 of the bed 10. Similar to the high/low assembly described above, the screw assemblies 38, 40 may be actuated manually or electrically. The screw assemblies 38, 40 shown in FIG. 2 comprise electrical motors 42, 44. Each motor 42, 44 drives a gear train 46, 48. The gear trains 46, 48 translate rotational motion from the motors 42, 44 to screws (not shown). The screws cooperatively engage drive tubes 50, 52. The drive tubes 50, 52 are connected to the head and foot sections 22, 24. Linear displacement of the drive tubes 50, 52 is effected by rotation of the screws to elevate the head and foot sections 22, 24.

Figure 3:
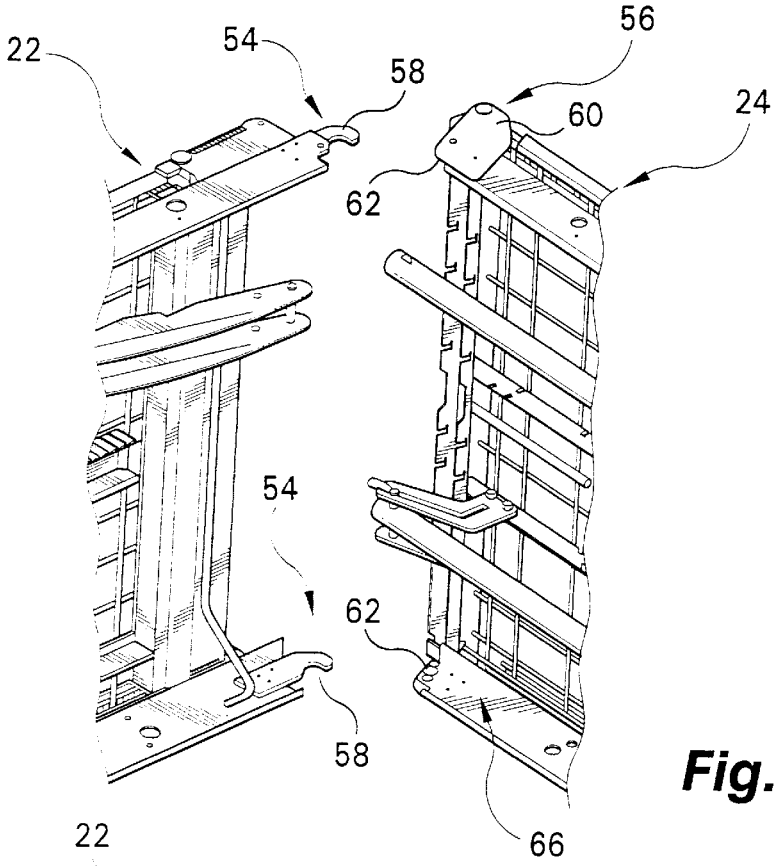
FIG. 3 is a partial bottom perspective view of the head and foot sections of the articulating bed shown in FIG. 1, further shown in a disassembled condition.
Figure 4:
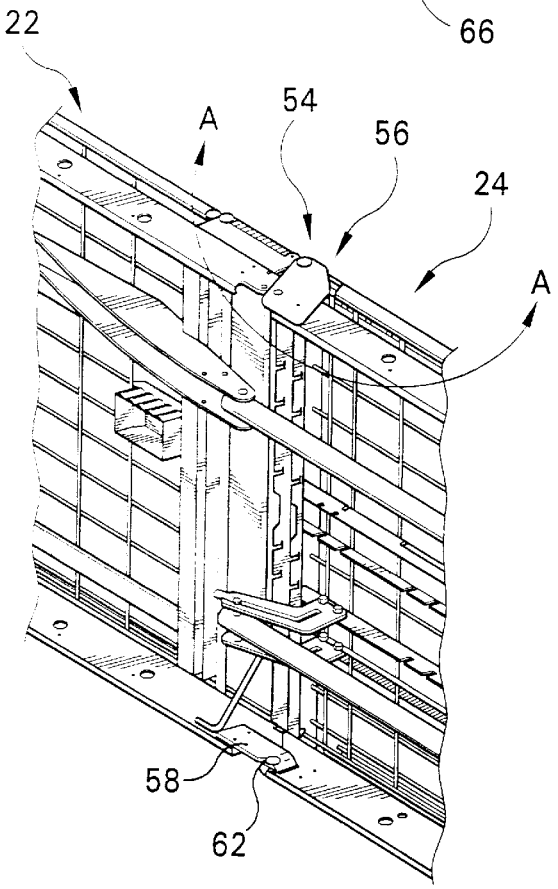
FIG. 4 is a partial bottom perspective view of the head and foot sections of the articulating bed shown in FIG. 1, further shown in an assembled condition.

Now, referring back to FIG. 1, it is shown that the bed 10 is separable into subcomponents. The subcomponents include the head and foot ends 12, 14 and the head and foot sections 22, 24. The head and foot sections 22, 24 are matingly engageable with one another. The engagement of the head and foot sections 22, 24 may be achieved in any suitable manner. For example, the head and foot sections 22, 24 may be provided with connectors, such as the connectors 54, 56 shown in FIGS. 3 and 4. One connector 54 includes a hook 58 extending from the head section 22. The other connector 56 includes a pin 62 extending inwardly from an inner surface of the foot section 24. Engagement of the connectors 54, 56 is accomplished as follows. First, position the head and foot sections 22, 24 at a right angle relative to each other with the bottom of each section 22, 24 at the inside of the angle. Next, insert the hooks 56 within the frame of the foot section 24 and engage the hooks 56 with the pin 62. Finally, pivot the head and foot sections 22, 24 relative to one another in the direction A until the two sections 22, 24 abut one another and form a substantially planar structure. When the connected sections 22, 24 are turned right side up and attached to the bed ends 12, 14, gravity will act upon the sections 22, 24 to maintain the connection.

The connected sections 22, 24 are supported by the head and foot ends 12, 14 of the bed 10. This can be accomplished in any suitable manner. One manner in which the head and foot sections 22, 24 may be supported by the head and foot ends 12, 14 is shown in FIGS. 1 and 2. As shown in FIG. 1, upwardly directed hooks 64 can extend perpendicularly and inwardly from the head and foot ends 12, 14. Moreover, as shown in FIGS. 1 and 2, rivet plates 66 can extend from the ends of the head and foot sections 22, 24. Rivets 68, as clearly shown in FIG. 2, can extend perpendicularly from the surface of each rivet plate. The rivets 68 are engageable with the hooks 64 extending from the head and foot ends 12, 14 by first placing the sections 22, 24 adjacent respective bed ends 12, 14. Next, raise the head and foot sections 22, 24 and position the rivets 68 extending from the rivet plates 66 above the hooks 64 extending from the respective bed ends 12, 14. Finally, lower the head and foot sections 22, 24 so as insert the rivets 68 into the hooks 64. Gravity will retain the rivets 64 in contact with the hooks 64 which, in turn, support the head and foot sections 22, 24.

In packaging the bed 10, the head and foot ends 12, 14 are packaged together, and the head and foot sections 22, 24 are packaged separately. The head section 22 and the foot section 24 are packaged in two other separate parcels. A range of dimensions for the head and foot ends 12, 14 and the head and foot sections 22, 24 is critical. The parcels in which the head and foot ends 12, 14 and the head section 22 and the foot section 24 are packaged cannot exceed the limitations on dimensions established by the couriers. For example, if shipping the parcels by UPS, the sum of the length and girth of the each parcel cannot exceed 130 inches. Moreover, the weight of any one parcel cannot exceed 150 pounds. If shipping the parcels by Federal Express, the sum of the length and girth of the each parcel cannot exceed 165 inches. So, to expand the selection of couriers, the sum of the length and girth of the parcels should not exceed 130 inches and the weight of the parcel should not exceed 150 pounds.

In packaging the head and foot ends 12, 14 and the head and foot sections 22, 24, the manufacturer is limited by two constraints: (1) the standard size of a conventional mattress, and (2) the internal dimensions of the parcel package. The head and foot sections 22, 24 of an articulating bed 10 must be dimensioned to support a standard size mattress 20. A standard hospital bed size mattress has an approximate length of 80 inches and an approximate width of 35 inches. Knowing the approximate length of a standard size mattress to be 80 inches, it should be clear that the minimum distance between the head and foot ends 12, 14 of the bed 10 cannot be less than 80 inches. Any movable parts of the head and foot sections 22, 24, respectively, must be spaced apart from the head and foot ends 12, 14 of the bed 10. This requirement is a "power crush point" requirement imposed by United Underwriters Laboratories, Incorporated of Northbrook, Ill. The power crush point requirement calls for 2 inches of clearance between movable parts of the head and foot sections 22, 24 and the head and foot ends 12, 14, respectively. Hence, if the sleep surface 18 were 80 inches in length, then two inches of clearance would be required at each end of the sleep surface 18, establishing a total length of 84 inches. It should be noted, however, that there is no requirement prohibiting the mattress 20 from overextending movable parts of the sleep surface 18. Hence, if the mattress 20 is permitted to overextend each end of the sleep surface 18 by two inches, the power crush point requirement would be met and the overall length of the sleep surface would be reduced to 76 inches. So, the length of the sleep surface 18 may range from 76 to 84 inches.

Now, with regard to the width of the sleep surface 18, it should be noted that there may be a tendency for user's of the bed 10 to sit on the side edge of the sleep surface 18. If the mattress 20 is permitted to overextend the sides of the sleep surface 18, an unstable seating condition may occur. In anticipation that a user may sit on the side edge of the sleep surface 18, it may be more suitable to provide a sleep surface 18 having a minimum width equivalent to the width of the mattress 20, that is, 35 inches. This will provide a more stable seating condition than would be provided if the sides of the mattress 20 were permitted to overextend the sleep surface 18. Hence, for the purposes of this description, the minimum width of the sleep surface 18 is 35 inches.

If the two sections 22, 24 of the sleep surface 18 are to be substantially uniform in width and thickness, it would stand to reason that the length of each section 22, 24 would likewise be substantially equivalent to each other if the object is to maximize on the parcel dimensions allowable by UPS. Hence, if the bed frame 16 and the sleep surface 18 are separable into two parts of substantially equivalent length and width, each section would carry the minimum dimensions in the range of 38–42 inches in length and 35 inches in width. The maximum permissible thickness can be obtained using the following formula: L+2W+2T=130 inches, or (130 inches−L−2W)/2=T. The maximum allowable thickness then is (130 inches−38 inches−2(35 inches))/2=11 inches. The minimum permissible thickness can be obtained using the same formula, as follows: (130 inches−42 inches−2(35 inches))/2=9 inches. Hence, the thickness of each section 22, 24 can be in the range of 9 to 11 inches. The overall length by width by thickness dimensions can be in the range of 38 inches×35 inches×11 inches to 42 inches×35 inches×9 inches.

The dimensions arrived at above can be affected by other considerations. For example, in accordance with the present invention, the length of the sections 22, 24 can be influenced by ancillary components, such as the connectors 54, 56 for coupling the head and foot sections 22, 24 together. As set forth above, one of these connectors 54, 56 is in the form of a pair of hooks 58. The hooks 58 extend from the end of one of the sections 22, 24. Although the hooks 58 shown extend from the head section 22, it should be understood that the hooks 58 may extend from the foot section 24. If the hooks 58 have a length in the range of 1.25 to 2 inches, the overall length of the bed section 22 would be increased by 1.25 to 2 inches. Hence, the head section 22 may have a length in the range of 39.20 to 44 inches. This would affect the thickness of the section 22 as follows: (130 inches−39.25 inches−(2)(35 inches))/2=10.38 inches, or (130 inches−44 inches−(2)(35 inches))/2=8 inches. Hence, the thickness of the head section 22 could be in the range of 8 to 10.38 inches.

Other structural limitations of the bed 10 may affect the allowable dimensions of the head and foot sections 22, 24. For example, the rivet plates 66 extending from the ends of the head and foot section 22, 24 may be in the range of 1.25 to 2 inches in length. This could affect the length of the foot section 24 in a manner similar to that in which the connector 54 affects the length of the head section 22, as described above. Moreover, the head section 22 can be further affected as follows: (130 inches−46 inches−(2)(35 inches))/2=7 inches. In addition to the rivet plates 66 affecting the length of the head and foot sections 22, 24, the width of the head and foot section will be affected by the rivets 68 extending from the rivet plates 66. If the length of the rivets 68 is 0.50 inch, the width of each section 22, 24 will increase by 1 inch because the rivets 68 extend in outwardly, in opposing directions, from each rivet plate 66. Hence, the width of each section 22, 24 would increase to 36 inches. This would affect the thickness as follows: (130 inches−46 inches−(2)(36 inches))/2=6 inches.

In addition to the foregoing effects on the dimensions of the foot section 24, the dimensions may be further affected by auxiliary components. For example, the drive tubes 50, 52 of the screw assemblies 38, 40 may extend beyond the foot section 24. If the drive tubes 50, 52 extend beyond the foot section 24 as much as 1.25 inches, the length of the foot section 24 would be further affected as follows: (130 inches−43.25 inches−(2)(36 inches))/2=7.38 inches. Moreover, if the screw assemblies 38, 40 are actuated manually, the hand cranks (not shown) may extend up to 1.25 inches beyond the end of the foot sections 24. This would further increase the length of the foot section to 44.50 inches. This would affect the thickness of the foot section as follows: (130 inches−44.50 inches−(2)(36 inches))/2=6.75 inches.

In summary, the length by width by thickness dimensions of the foot section 24 can be in the range of 38 inches×35 inches×11 inches to 44.50 inches×36 inches×6.75 inches. The dimension of the head section 22 can be in the range of 38 inches×35 inches×11 inches to 46 inches×36 inches×6 inches.

Figure 9:
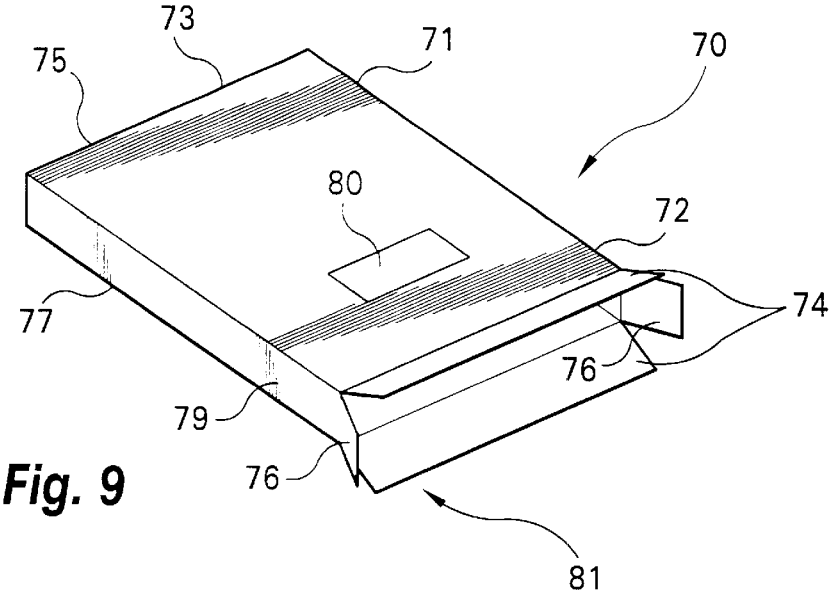
FIG. 9 is a perspective view of a paperboard box for use in packaging the articulating bed.
Figure 10:
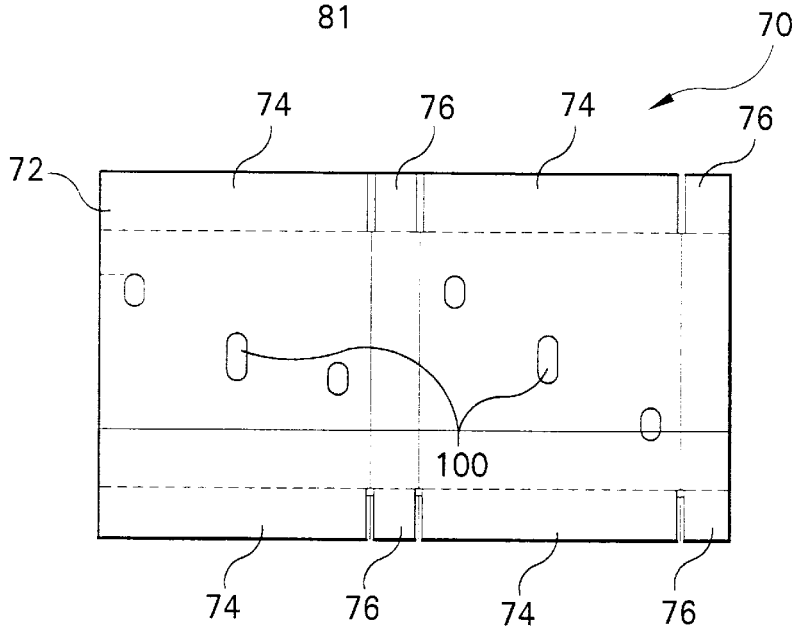
FIG. 10 is a plan view of the paperboard box shown in FIG. 5 further shown unfolded.

As set forth above, the foregoing dimensions are further affected by the parcel packaging itself. Clearly, the maximum external dimensions of the parcel are known and defined by the formula L+2W+2T=130 inches. That is to say, the length and girth of the parcel cannot exceed 130 inches. Given the external dimensions of the parcel, the internal dimensions can be arrived at as follows. As shown in FIGS. 9 and 10, the parcel packaging can include a paperboard box 70. The paperboard box 70 shown has six sides 71, 73, 75, 77, 79, and 81. The paperboard box 70 is constructed from paperboard material 72. The paperboard material 72 can be substantially uniform in thickness. For example, the paperboard material can have an approximate thickness of 0.25 inch. Two surfaces of the paperboard box 70 will have overlapping flaps 74, 76. Knowing this, a range of maximum internal dimensions for a paperboard box 70 of this construction can be arrived at as follows: First, determine the total thickness that the paperboard material will add to the length and girth of the packaged head and foot sections 22, 24. This is derived by determining the sum of twice the thickness of the paperboard material 72 of the two overlapping flaps 74, 76 making up two opposing sides of the paperboard box 70 and four times the thickness of a single layer of paperboard material 72 making up the four remaining sides of the paperboard box 70. This sum is as follows: (2)(0.5 inch)+(4)(0.25 inch)=3 inches. Hence, if the, the paperboard material has an approximate thickness of 0.25 inch, the sum of the length and the girth of the head and foot ends combined as well as the head section and the foot section each cannot exceed 127 inches (130 inches−3 inches=127 inches). Factor this into the above ranges of permissible dimensions for the head and foot sections 22, 24 to arrive at the maximum internal dimensions for a paperboard box 70. For example, the range of dimensions for the foot section 24 can be arrived at as follows: First, determine the thickness of the foot section 24 at the low range as follows: T=(130 inches−3 inches−38 inches−(2)(35 inches))/2=9.50 inches. Next, determine the thickness of the foot section 24 at the higher range as: T=(130 inches−3 inches−44.50 inches−(2)(36 inches))/2=5.25 inches). Hence, the length by width by thickness dimensions for the foot section may be in the range of 38 inches×35 inches×9.50 inches to 44.50 inches×36 inches×5.25 inches. The dimensions of the head section 22 can be in the range of 38 inches×35 inches×11 inches to 46 inches×36 inches×6 inches. The range of dimensions for the head section 22 can be arrived at in a similar manner. First, determine the thickness of the head section 22 at the low range, as follows: T=(130 inches−3 inches−38 inches−(2)(35 inches))/2=9.50 inches. Next, determine the thickness of the foot section 24 at the higher range as: T=(130 inches−3 inches−46 inches−(2)(36 inches))/2=4.5 inches). Hence, the length by width by thickness dimensions for the foot section may be in the range of 38 inches×35 inches×9.50 inches to 44.50 inches×36 inches×5.25 inches. The dimension of the head section 22 can be in the range of 38 inches×35 inches×9.5 inches to 46 inches×36 inches×4.5 inches. It should be understood that a change in the thickness of the paperboard material 72 would result in a change in the internal dimensions of the paperboard box 70. For example, a paperboard material 72 having an approximate thickness of 0.125 inch would result in a paperboard box 70 having internal dimensions the length and girth of which would be approximately 128.5 inches. This would obviously alter the range of dimensions set forth above.

The foregoing ranges of dimensions establish a set of parameters to be followed in constructing the paperboard box 70. The internal dimensions of the paperboard box 70 are going to be slightly greater than the dimensions chosen within the ranges provided to permit the head and foot sections 22, 24 to be inserted in the paperboard box 70 with relative ease.

Figure 5:
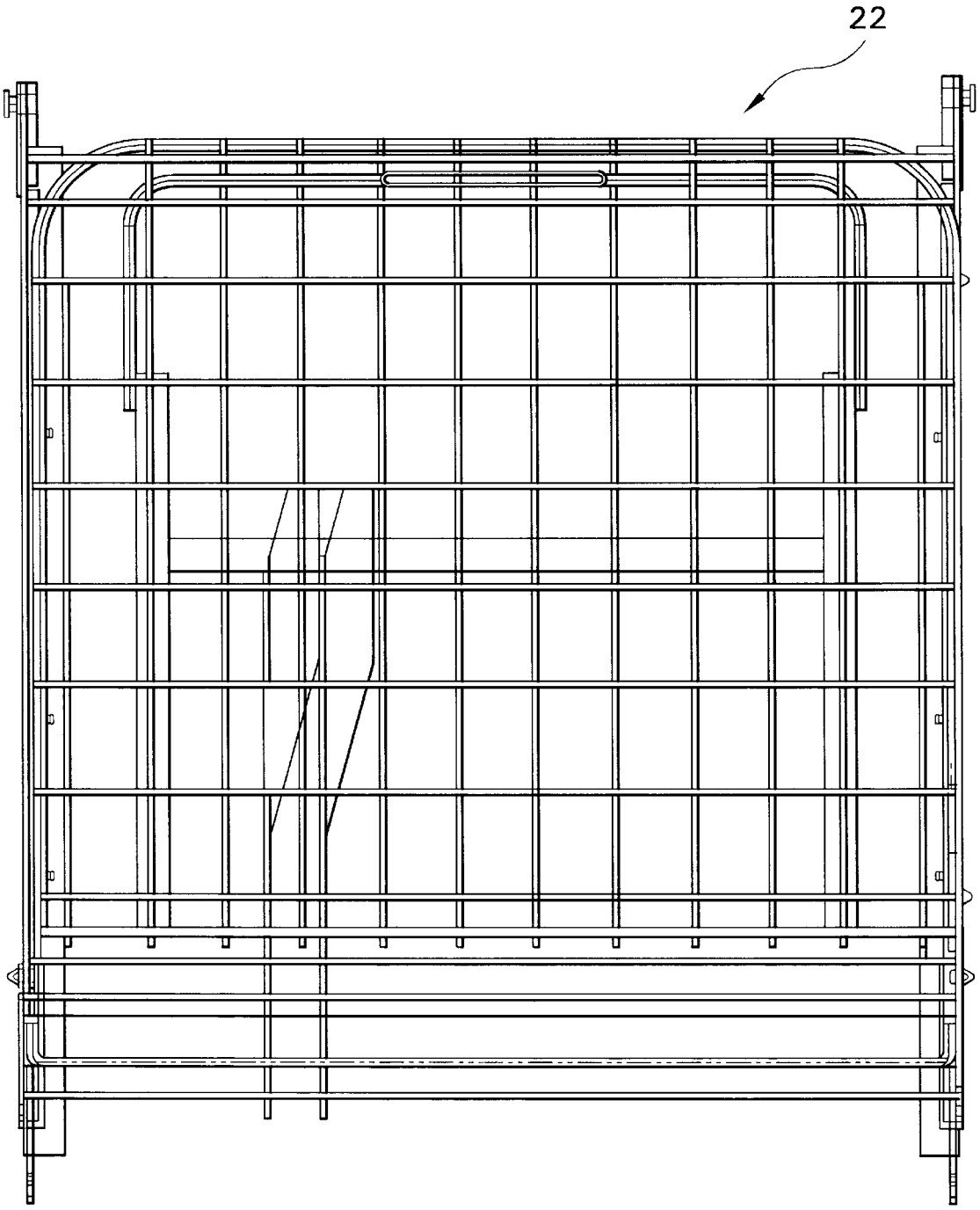
FIG. 5 is a plan view of the head section of the articulating bed.
Figure 6:
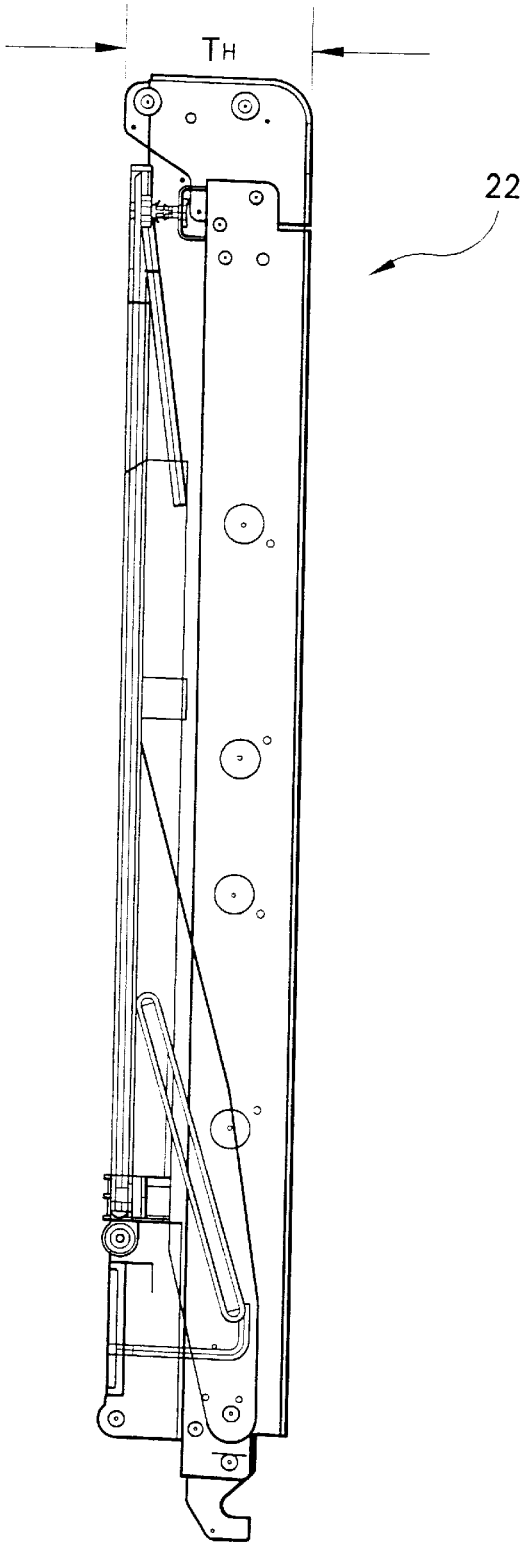
FIG. 6 is a side elevation of the head section shown in FIG. 5.
Figure 7:
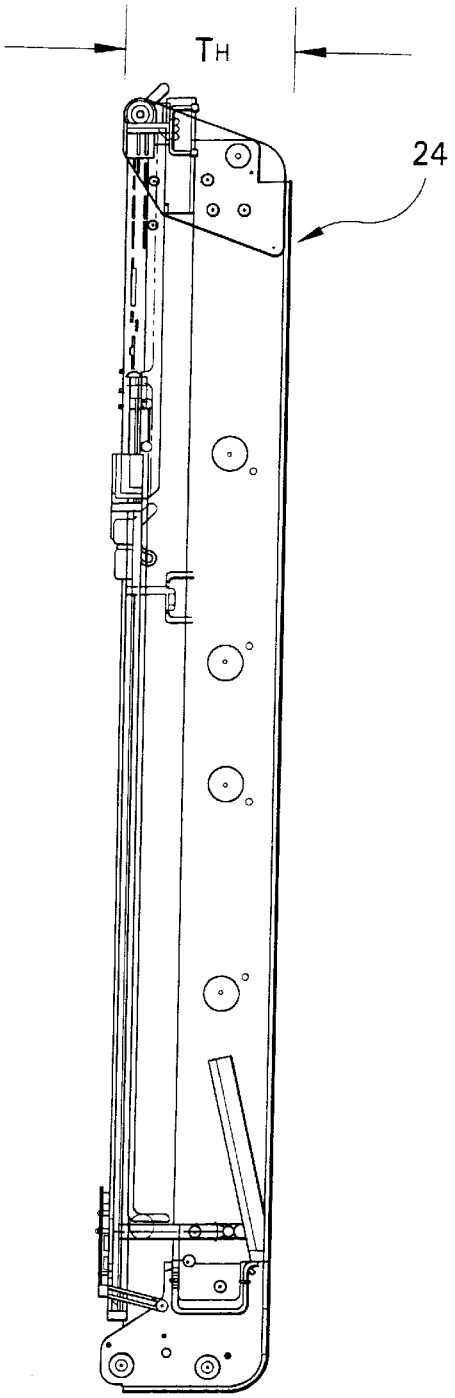
FIG. 7 is a side elevation of the foot section of the articulating bed.
Figure 8:
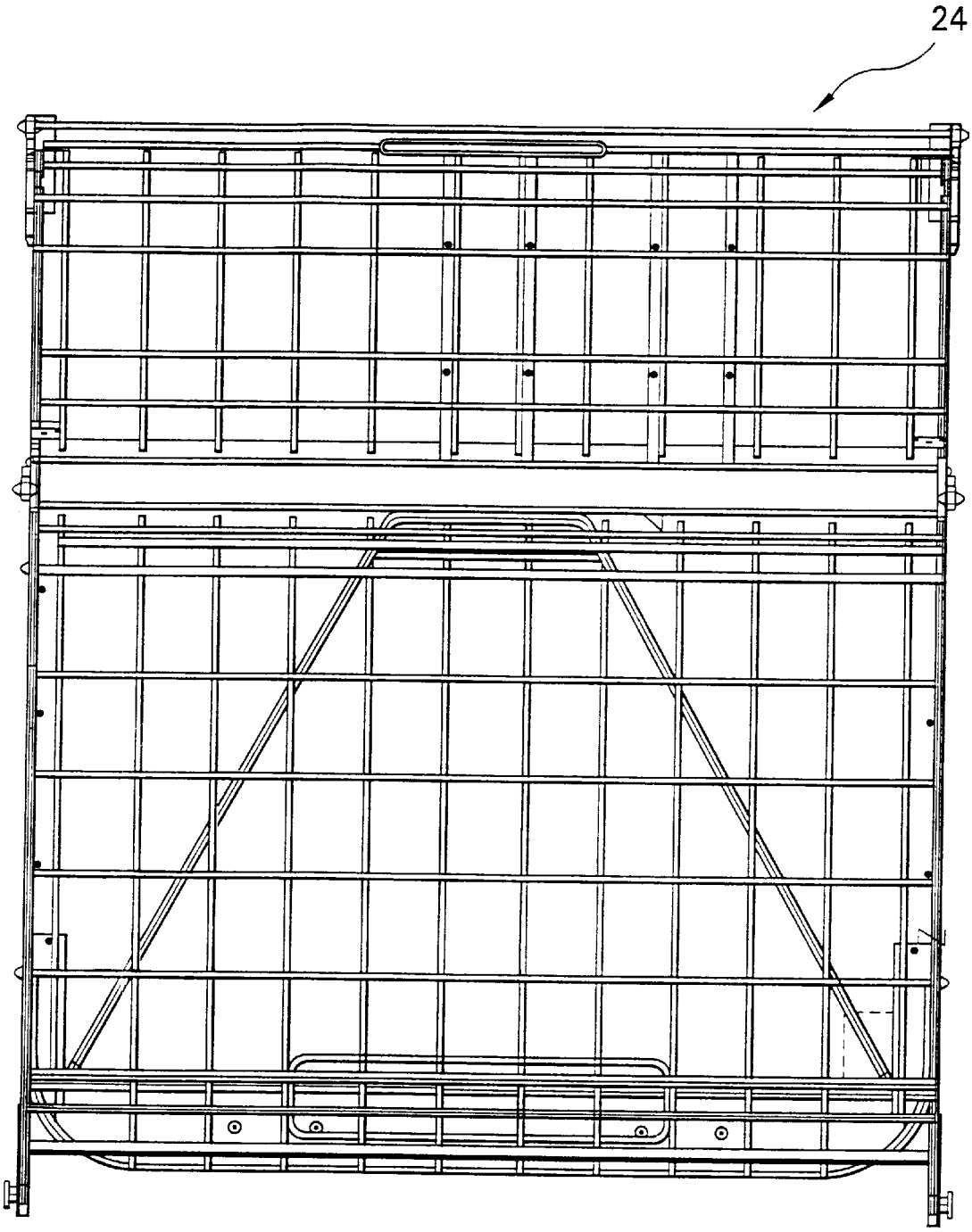
FIG. 8 is a plan view of the foot section shown in FIG. 7.

FIGS. 5 through 8 illustrate examples of head and foot sections 22, 24 that carry dimensions within the foregoing ranges. FIGS. 5 and 6 show a head section 22 having a length $L_H$ of 43.665 inches and a width $W_H$ of 35.85 inches and a thickness $T_H$ of 5.22 inches. FIGS. 7 and 8 show a foot section 24 having a length $L_F$ of 43.50 inches and a width $W_F$ of 35.96 inches and a thickness $T_F$ of 5.22 inches. Referring back to FIG. 9, a paperboard box 70 suitable for packaging both sections 22, 24 carries internal dimensions having a length $L_P$ of 44.50 inches and a width $W_P$ of 36.0 inches and a thickness $T_P$ of 5.63 inches.

Figure 11:
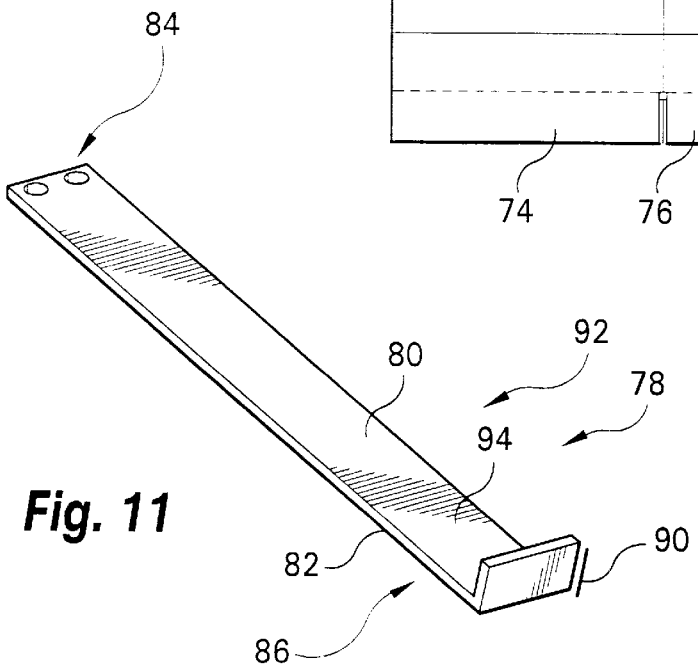
FIG. 11 is a perspective view of innerpacking.
Figure 12:
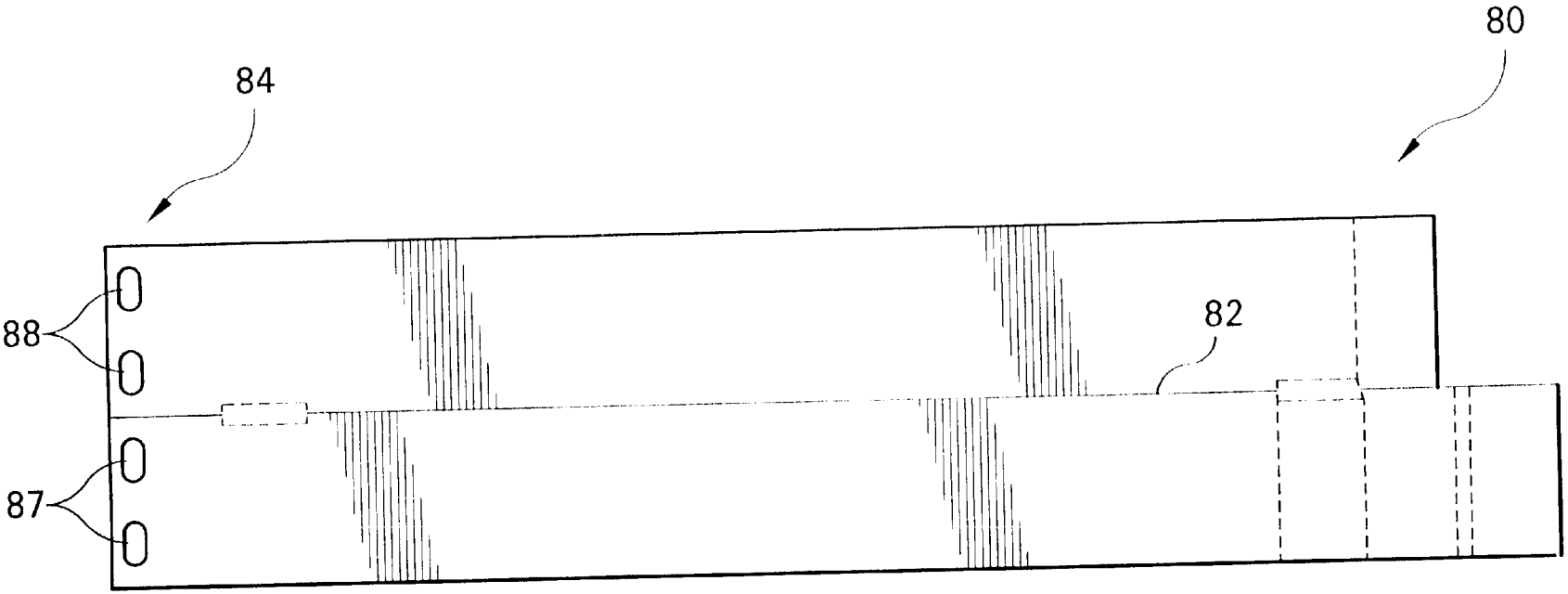
FIG. 12 is a plan view of the innerpacking shown in FIG. 11 further shown unfolded.
Figure 13:
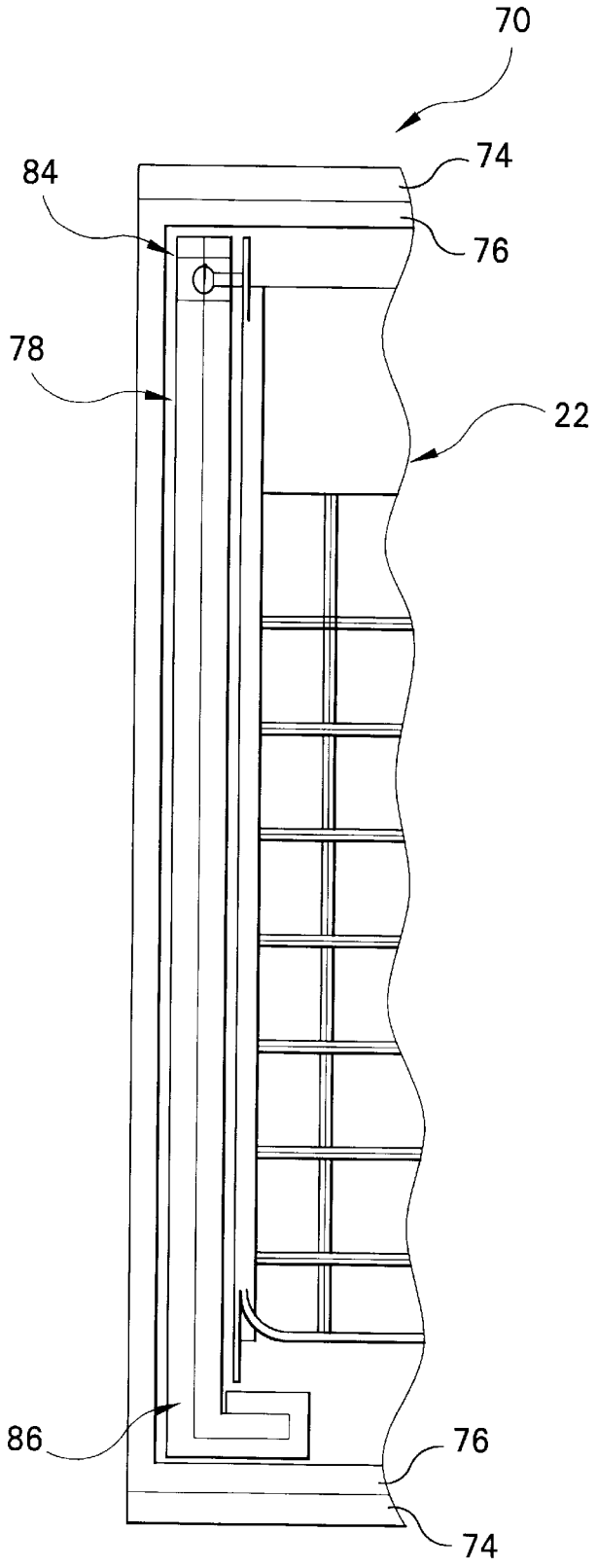
FIG. 13 is partial cutaway of a head section packaged in a paperboard box with the innerpacking.

To hold the sections 22, 24 firmly in place within the paperboard box 70, a suitable innerpacking can be provided. An example of such innerpacking is shown in FIGS. 11 and 12. The innerpacking 78 shown comprises a single sheet of paperboard material 80 structured to fold upon itself along fold line 82. The innerpacking includes a first end 84 and a second end 86. The first end 84 of the paperboard material 80 includes a plurality of openings 87, 88. Two of the openings 87 align with the other two openings 88 upon folding the paperboard material 80. The openings 87, 88 are provided for receiving the rivets 68 extending from the rivet plates 66 (clearly shown in FIG. 2). The second end of the paperboard material 80 is structured to fold upon itself so as to form a three-layer end 90. The three layer end 90 further folds at a right angle to the remainder of the paperboard material 80 so as to form and L-shaped configuration 92 having a main body 94 and a leg 96. The main body 94 of the L-shaped configuration 92 carries a length $L_B$ of 44.50 inches and a width $W_B$ of 0.50 inch and a thickness $T_B$ of 5.63 inches. The leg 96 carries a length $L_L$ of 0.75 inch and a width $W_L$ of 3.50 inch and a thickness $T_W$ of 5.63 inches width of the leg 96 is 3.50 inches. As illustrated in FIG. 13, it is contemplated that the innerpacking 78 placed adjacent each side of each section 22, 24. The innerpacking 78 is structured to receive the rivets 68 extending from the rivet plates 66. Moreover, the innerpacking 78 is structured to fold over the hooks 58 at the end of the head section 22 and merely fold over the end of the foot section 24 to enhance the structural integrity of the corners of the paperboard box 70. The innerpacking 78 reduces the risk of the head and foot sections 22, 24 shifting about in the paperboard box 70 and protects the hooks 58 extending from the head section 22.

It should be understood that the head and foot sections 22, 24, as well as any ancillary components, such as the connectors 54, 56 and the rivet plates 66, and auxiliary components, such as the high/low and screw assemblies 28, 38, 40, must fit within the range of dimensions chosen. For example, if the high/low assembly 28 and the screw assemblies and 38, 40 must fit within the frame 16 of the foot section 24, then the thickness of the high/low assembly 28 and the screw assemblies 38, 40 cannot exceed the thickness of the frame 16 of the foot section 24, as shown in FIG. 2. It is to be further understood that the ancillary and auxiliary components may be shipped disassembled from the head and foot sections 22, 24 so as to permit the dimensions of the head and foot sections 22, 24 to be varied within the given ranges.

Figure 14:
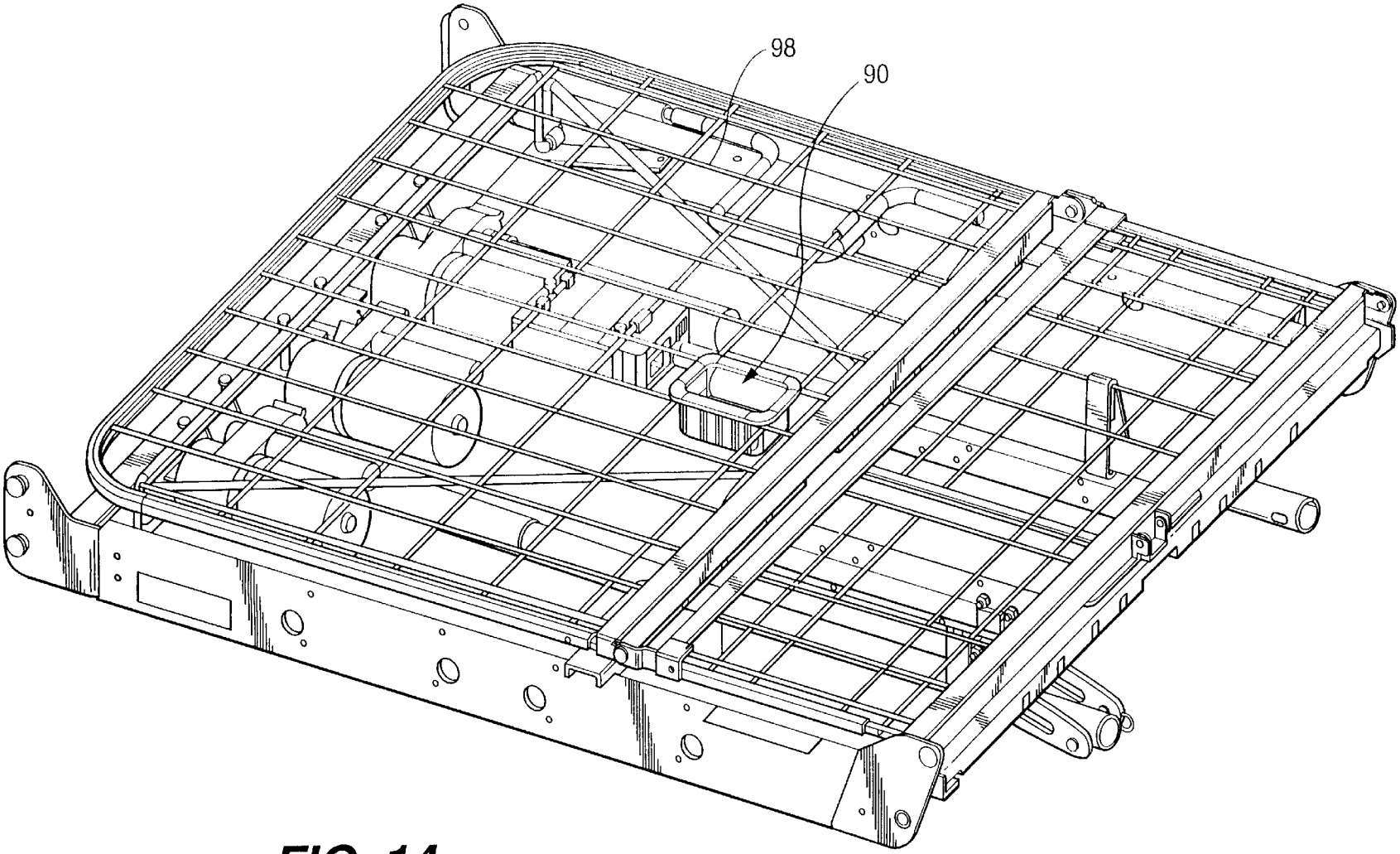
FIG. 14 is a perspective view of a handle engaging the mattress support grid of the foot section of the bed.

Referring back to FIGS. 9 and 10, a view hole 100 can be provided in the paperboard box 70. Moreover, the head and foot sections 22, 24 may each include a mattress support grid formed from wire segments, and a handle may be engageable with the mattress support grid. For example, as shown in FIG. 14, a handle 96 is engageable with the mattress support grid 98 of the foot section 24. The view hole 100 may be arranged so as to co-align with the handle 96 engaging the mattress support grid 98 upon inserting the head and foot sections 22, 24 into a paperboard box 70.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. In combination:

a bed section having a length of 45.3 inches and a width of 36 inches and a thickness of 5.6 inches;

a screw assembly, said bed section comprising a frame and a mattress support grid, said frame and said mattress support grid each having a thickness, said thickness of said frame section not exceeding the difference between said thickness of said bed section and said thickness of said mattress support grid, said screw assembly having a thickness not exceeding said thickness of said frame; and packaging for containing said bed section, said packaging comprising a box having a length and a girth the sum of which does not exceed 130 inches, said bed section and said screw assembly being dimensioned and configured to fit in said box, said bed section, said screw assembly and said box having a combined weight not exceeding 150 pounds.

2. In combination:

a bed section;

packaging for containing said bed section, said packaging comprising a box having a length and a girth, the sum of said length and girth not exceeding 130 inches, said bed section being dimensioned and configured to fit in said box, said bed section and said box having a combined weight not exceeding 150 pounds, and a handle, said bed section comprising a mattress support grid, said handle being engageable with said mattress support grid, said packaging comprising a view hole, said view hole being positioned to co-align with said handle upon engaging said handle with said support grid and further upon containing said bed section in said packaging.

3. In combination:

a bed section having dimensions in the range of 38 to 46 inches in length and 35 to 36 inches in width and 4.5 to 11 inches in thickness;

packaging for containing said bed section, said packaging comprising a box having a length and a girth, the sum of said length and girth not exceeding 130 inches, said box having internal dimensions, said bed section being dimensioned and configured to fit said internal dimensions of said box, said bed section and said box having a combined weight not exceeding 150 pounds; and a handle, said bed section comprising a mattress support grid, said handle being engageable with said mattress support grid, said packaging comprising a view hole, said view hole being positioned to co-align with said handle upon engaging said handle with said support grid and further upon containing said bed section in said packaging.

4. In combination:

a bed section;

packaging for containing said bed section, said packaging comprising a box formed of paperboard material and having a length and a girth, the sum of said length and girth not exceeding 130 inches, said bed section being dimensioned and configured to fit in said box, said bed section and said box having a combined weight not exceeding 150 pounds; and a handle, said bed section comprising a mattress support grid, said handle being engageable with said mattress support grid, said packaging comprising a view hole, said view hole being positioned to co-align with said handle upon engaging said handle with said support grid and further upon containing said bed section in said packaging.

5. A bed section comprising:

a bed frame having a length and a width and a thickness, the bed frame being adapted to support at least one auxiliary component within the bed frame;

a mattress support grid supported by the frame; and at least one connector provided on the bed frame, the connector being releasably engageable with a bed frame of another bed section, wherein the sum of the length and twice the width and twice the thickness of the bed frame and any auxiliary components supported by the bed frame together with the mattress support grid and the connector does not exceed 130 inches and wherein the weight of the bed frame and any auxiliary components supported by the bed frame together with the mattress support grid and the connector does not exceed 150 pounds.

6. The bed section of claim 5 wherein the bed section has dimensions in the range of about 38 to 46 inches in length and about 35 to 36 inches in width and about 4.5 to 11 inches in thickness.

7. The bed section of claim 5 wherein the bed section is a head section of a bed, the head section having a length of about 43.7 inches and a width of about 36.9 inches and a thickness of about 5.5 inches.

8. The bed section of claim 5 wherein the bed section is a foot section of a bed, the foot section having a length of about 45.3 inches and a width of about 36 inches and a thickness of about 5.6 inches.

9. The bed section of claim 5 wherein the bed section is adapted to be contained in packaging formed of a paperboard material box that has a uniformed thickness of approximately 0.1 inch.

10. The bed section of claim 5 wherein the mattress support grid is adapted to be engaged by a handle and the bed section is adapted to be contained in packaging having a view hole with which the handle co-aligns.

11. The bed section of claim 5 wherein the bed is an articulating bed.

12. A bed section for use in combination with another bed section, the combination of which may be supported by a head end and a foot end to form a bed, the bed section comprising:

a bed frame having a length and a width and a thickness, the bed frame being adapted to support at least one auxiliary component within the bed frame;

a sleep surface supported by the bed frame, the sleep surface including a mattress support grid; and at least one connector provided on the bed frame, the connector being releasably engageable with a bed frame of the other bed section, wherein the sum of the length and twice the width and twice the thickness of the bed frame and any auxiliary component supported by the bed frame together with the mattress support grid and the connector does not exceed 130 inches and the weight of the bed frame and any auxiliary component supported by the bed frame together with the mattress support grid and the connector does not exceed 150 pounds.

13. The bed section of claim 12 wherein the bed section has dimensions in the range of about 38 to 46 inches in length and about 35 to 36 inches in width and about 4.5 to 11 inches in thickness.

14. The bed section of claim 12 wherein the bed section is a head section of a bed, the head section having a length of about 43.7 inches and a width of about 36.9 inches and a thickness of about 5.5 inches.

15. The bed section of claim 12 wherein the bed section is a foot section of a bed, the foot section having a length of about 45.3 inches and a width of about 36 inches and a thickness of about 5.6 inches.

16. The bed section of claim 12 wherein the bed section is adapted to be contained in packaging formed of a paperboard material box that has a uniformed thickness of approximately 0.1 inch.

17. The bed section of claim 12 wherein the mattress support grid is adapted to be engaged by a handle and the bed section is adapted to be contained in packaging having a view hole with which the handle co-aligns.

18. The bed section of claim 12 wherein the bed is an articulating bed.

19. In combination:

a bed section comprising:

a bed frame having a length and a width and a thickness, the bed frame being adapted to support at least one auxiliary component;

a sleep surface supported by the frame, the sleep surface including a mattress support grid; and at least one connector provided on the bed frame, the connector being releasably engageable with a bed frame of another bed section; and packaging for containing the bed section, wherein the sum of the length and twice the width and twice the thickness of the bed frame and any auxiliary component supported by the bed frame together with the mattress support grid and the connector and the packaging does not exceed 130 inches and the weight of the bed frame and any auxiliary component supported by the bed frame together with the mattress support grid and the connector and the packaging does not exceed 150 pounds.

20. The bed section of claim 19 wherein the bed section has dimensions in the range of about 38 to 46 inches in length and about 35 to 36 inches in width and about 4.5 to 11 inches in thickness.

21. The bed section of claim 19 wherein the bed section is a head section of a bed, the head section having a length of about 43.7 inches and a width of about 36.9 inches and a thickness of about 5.5 inches.

22. The bed section of claim 19 wherein the bed section is a foot section of a bed, the foot section having a length of about 45.3 inches and a width of about 36 inches and a thickness of about 5.6 inches.

23. The bed section of claim 19 wherein the packaging is in the form of a paperboard material box that has a uniformed thickness of approximately 0.1 inch.

24. The bed section of claim 19 wherein the mattress support grid is adapted to be engaged by a handle and the packaging has a view hole with which the handle co-aligns.

25. The bed section of claim 19 wherein the bed is an articulating bed.

* * * * *